US005516314A

United States Patent [19]

Anderson

[11] Patent Number: 5,516,314

[45] Date of Patent: May 14, 1996

[54] SELF-SUPPORTING FIGURE

[76] Inventor: S. Catherine Anderson, 208 Ridge Dr., Sikeston, Mo. 63801

[21] Appl. No.: 402,337

[22] Filed: Mar. 10, 1995

Related U.S. Application Data

[63] Continuation-in-part of Ser. No. 169,371, Dec. 20, 1993, abandoned.

[51] Int. Cl.[6] ..... A63H 3/04; A63H 3/36

[52] U.S. Cl. ..... 446/374; 446/371; 446/268; 446/390; 446/391

[58] Field of Search ..... 446/369, 370, 446/371, 373, 374, 268, 325, 326, 354, 355, 356, 396, 390, 391, 99, 97

[56] References Cited

U.S. PATENT DOCUMENTS

| | | | |
|---|---|---|---|
| 1,317,060 | 9/1919 | Witkowski | 446/374 |
| 1,364,881 | 1/1921 | Koch | 446/374 |
| 3,624,691 | 11/1971 | Robson | 446/374 |
| 4,575,351 | 3/1986 | Gonzalez | 446/369 X |
| 4,968,281 | 11/1990 | Smith et al. | 446/369 |

FOREIGN PATENT DOCUMENTS

| | | | |
|---|---|---|---|
| 0592356 | 4/1994 | European Pat. Off. | 446/391 |
| 281791 | 12/1927 | United Kingdom | 446/370 |
| 383834 | 11/1932 | United Kingdom | 446/370 |
| 1571352 | 7/1980 | United Kingdom | 446/370 |
| 2197800 | 6/1988 | United Kingdom | 446/370 |

*Primary Examiner*—Mickey Yu
*Assistant Examiner*—D. Neal Muir
*Attorney, Agent, or Firm*—Polster, Lieder, Woodruff & Lucchesi

[57] ABSTRACT

A self-supporting, two-legged figure includes an armature with leg wires of stiffly bendable material, extending a substantial distance into the torso preferably at least ¾ of the way to the head end of the torso a body supported by the leg wires and feet assemblies fixedly connected to a lower end of each of the leg wires. The body includes a head, hands, a torso and arms that may be part of the hands. The head and hands are made of clay, and are generally at least twice as heavy as the torso, making the figure top-heavy. At least one of the feet assemblies has a lower surface for engaging a support surface but independent of the support surface. The feet assemblies weigh more than the entire rest of the figure, and have an effective support surface-engaging area to support the body in an erect or standing condition. The feet assemblies may include an ankle section in the form of a generally inverted conical container, containing heavy particulate material, such as buckshot, embracing the leg wire immediately contiguous an upper surface of the foot, whereby the weight of the feet is augmented but the leg wire can still be bent immediately above the foot within the ankle area.

13 Claims, 2 Drawing Sheets

SELF-SUPPORTING FIGURE

CROSS REFERENCE TO RELATED APPLICATION

This application is a continuation-in-part of application Ser. No. 08/169,371, filed Dec. 20, 1993 now abandoned.

BACKGROUND OF THE INVENTION

This invention has particular but not exclusive application to doll-like figures of substantial height, for example 12" or higher, as for example, the height of a small child, that are life-like in appearance, with heads sculpted of clay. Such dolls are usually one of a kind "artist" dolls, that in today's market command prices on the order of several thousands of dollars. It is highly desirable that the various elements of the figure be reasonably to scale. It is also desirable that the figure be displayed upright, that is, supported on two feet, although the figure need not be erect, but can also assume a crouching or forward or backward leaning pose. The need to keep the various parts of the figure in scale precludes the use of grossly over-sized feet or foreshortened legs, such as those shown in U.S. Pat. Nos. 4,094,093, and 5,224,896. At the same time, because of their value, and the fact that the heads are made of clay which may be porcelain or other medium such as resin that can be sculpted (molded or modeled) and permanently set, and are thus easily broken, figures of the type to which this invention is directed are now generally mounted on a base or supported by an external stand.

One of the objects of this invention is to provide a self-supporting "top-heavy" figure which is posable, and in which the feet are substantially in proportion to the body of the figure.

Other objects will become apparent to those skilled in the art in the light of the following description and accompanying drawing.

SUMMARY OF THE INVENTION

In accordance with this invention, generally stated, a self-supporting, posable, two legged figure is provided, supported in a standing position by leg wires of stiffly bendable material. The figure includes a body with a torso, head, hands, arms and legs, and feet assemblies. The feet assemblies may also include an ankle sack containing particulate material, such as buckshot, mounted on the leg wires above and contiguous the feet. Each of the feet is fixedly connected to a lower end of a leg wire. At least one of the feet has a lower surface for engaging a support surface but independent of the support surface. The feet assemblies that engage the support surface weigh more than the body including the head, hands, arms and torso, and the feet have an effective support surface-engaging area to support the body in an erect condition. The torso is made of relatively light material, so that the head and hands or head, arms and hands, if the arms are also sculpted, weigh at least as much as the torso, generally from two to three times as much, making the body top-heavy. In the embodiment in which an ankle sack is employed, the ankle member sack is flexible, so that the leg wire can be bent closely adjacent the foot, to facilitate posing of the figure in a desired manner. The weight of the particulate matter is cumulative with the weight of the feet, to add stability to the figure. The term "leg wire" is used to include a plurality of leg wires connected to each foot, because when the figure is more than 26" high, it is preferable to use multiple wires for each foot. If the pose of the lower leg is predetermined, it is not necessary to provide for bending at the ankle, or even the knee, but the head and arms can still be posed, and the body with respect to the legs.

As has been indicated, the legs, torso and arms of the body are preferably made of a light, soft material, and the hands and head, and in another embodiment, at least part of the arms and legs, of clay. The head is generally made solid, although a porcelain head may be hollow, but in any event the head is substantially heavier than the torso. The weight of the clay head accentuates the problem of making the figure self-supporting. The leg wires are connected internally of the torso to relatively soft metal wires to which the head and hands are connected. It is important that the leg wire be strong and only stiffly bendable, so as to resist any tendency to bend under the weight of the head and hands, and preferably to extend on the order of three-fourths of the way up into the torso, to at least the chest area of the figure. In the preferred embodiment, the feet are solid and made of metallic lead. In another embodiment, the foot assembly extends to the knee, or beyond, and the weight may be provided by lead shot or powder, consolidated with resin or the like to preclude any possible problem of leakage. It is the combination of stiffly bendable leg wire, strongly resistant to bending under the weight of the heavy head and hands and to swaying in response to small lateral forces, extending well up into the chest area of the torso, and the weight of the feet members, which exceeds that of the rest of the body, that gives the "top-heavy" figures of this invention their ability to stand.

IN THE DRAWINGS

In the drawings, FIG. 1 is a view in front elevation of a figure made in accordance with one embodiment of this invention;

DESCRIPTION OF THE PREFERRED EMBODIMENT

Figure 1:
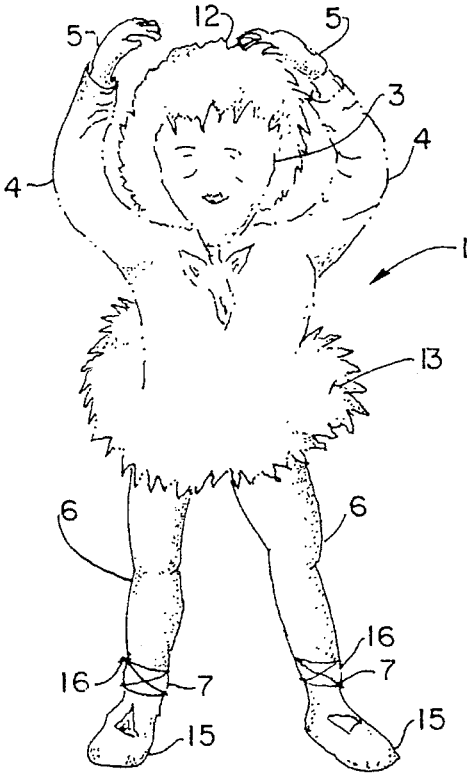

Referring now to FIGS. 1–6 of the drawings for one illustrative embodiment of figure of this invention, reference numeral 1 indicates a completed figure. The FIG. 1 has a torso 2, a head 3, arms 4, hands 5, legs 6, ankles 7, and feet 8. In this embodiment, as shown in FIG. 1, the figure is provided with hair 12, and a costume 13, which, merely by way of illustration, includes a tutu and ballet shoes 15, equipped with ribbons or laces 16.

Figure 2:
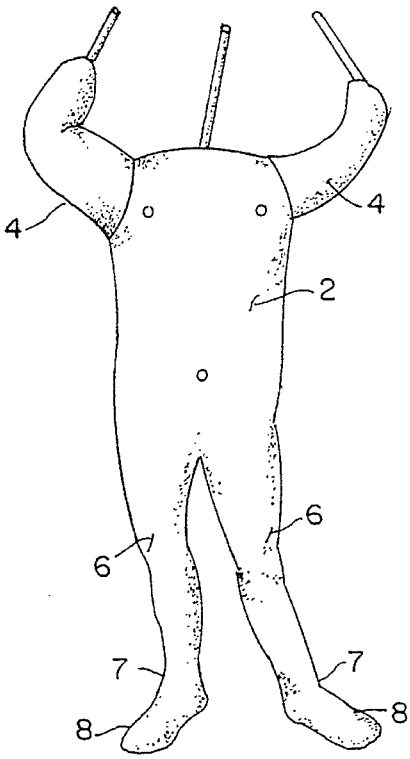
FIG. 2 is a view of the body, without ornamentation, and without shoes, head or hands.

FIG. 2 illustrates the figure without the costume or shoes, and without head or hands. In this embodiment, as shown in FIG. 2, the torso, arms, legs, ankles and feet are cloth covered, and the torso, arms and legs are filled with Polyfil or other light foam material, as is well known in the art.

Figure 3:
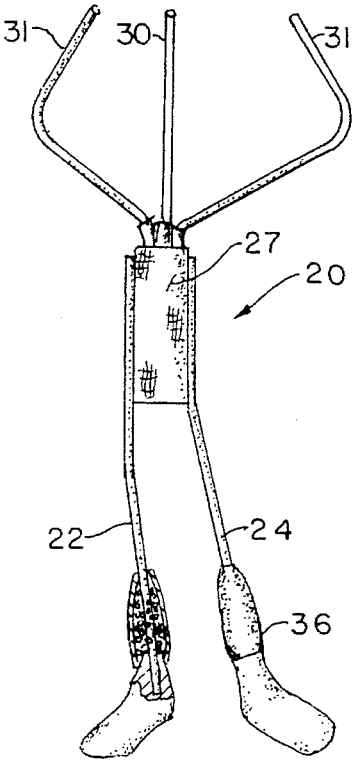
FIG. 3 is a view of internal support structure.
Figure 4:
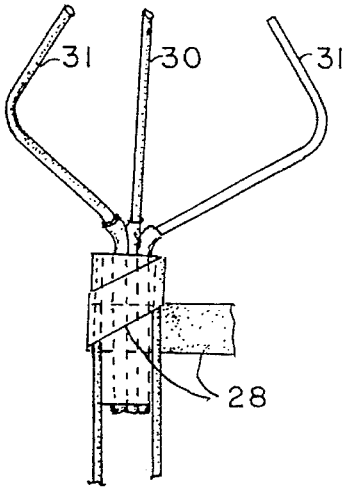
FIG. 4 is a fragmentary view in front elevation of the support structure shown in FIG. 3, showing a means of mounting the supporting leg wires to wires to which the head and hands of the figure are to be mounted.
Figure 5:
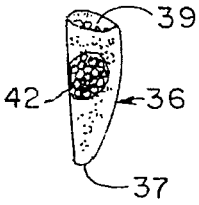
FIG. 5 is a view in perspective of one embodiment of ankle member.
Figure 6:
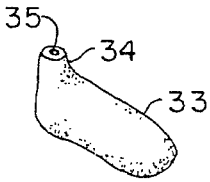
FIG. 6 is a view in perspective of a foot member to which a leg wire has not been attached, and on which no shoe has been mounted.

The body of the figure is built around and supported by an armature 20. The armature 20 includes leg wires 24 of a stiffly bendable material, such as number 11 gauge steel tie wire, which extend upwardly almost to a shoulder area of the figure, as shown in FIG. 3 The leg wires must be stiff enough to resist bending in response to the weight of the head and hands, and to resist sway of the body in response to minor lateral forces applied to the body. As in the case of the human body itself, remaining upright requires balance, and the application of too much lateral force will cause the figure to fall, but if sway is minimized, the figure will remain standing even when subjected to accidental nudges. In this embodiment, a section 27 of three-wire Romex cable is shown as taped, by means of tape 28, between the upper ends of the leg wires 22 and 24. Above the section 27, three copper wires projecting from the section 27 are stripped, as shown particularly in FIGS. 3 and 4, to form the support wires for the arms, hands, and head of the figure. The lower ends of the leg wires 22 and 24 are secured in an opening 35 in an ankle part 34 of lead feet 33. The lead feet 33 are of a size commensurate with the dimensions of the figure.

In order to augment the weight of the feet, and to permit the feet to be oriented to accommodate different poses of the figure, an ankle sack 36, in this embodiment, made of a smooth, flexible leather, is mounted on and around each of the leg wires 22 and 24, with a small end of the sack around the ankle part 34 of the foot 33. The feet 33 and sacks 36 make up feet assemblies. The sack 36 initially has an open upper larger end 39, through which the sack is filled with particulate heavy matter, such as No. 9 buckshot, and the upper end is then closed, either with a plug, or by gathering an upper edge around the wire and securing it with adhesive or with adhesive tape, for example. The sack 36 preferably extends to a point just below the height of the knee, so as to give shape to the calf, as well. The two feet assemblies 32 together weigh more than the entire rest of the body including the head and hands, and the head and hands weigh more than the torso, legs and arms. For example, if the figure is twenty-six inches tall, and the entire figure weighs about five and a quarter pounds (84 oz.), the head, arms and hands, sculpted of clay, together weigh at least twenty-six ounces, the torso, no more than nine to ten ounces and the feet assemblies 32, on the order of forty-eight ounces. If the figure is on the order of seventeen inches tall, and weighs forty-seven ounces, the head, arms and hands may weigh on the order of seventeen ounces (head, eleven, arms and hands, six), the torso, six ounces, and the feet assemblies, twenty-four ounces. As a general proposition, a taller figure will require a greater amount of weight in the feet assemblies, but the torso and head and arm and hand weights will not increase proportionately, so the ratio of weight of body and feet assemblies will increase with the taller figure, better to assure stability of the figure.

The feet 33 have sufficient surface area under them to support the figure, but they are shown in this embodiment as encased in shoes, in this case ballet slippers. They can as well be shoes of different styles and characters.

As has been indicated, when the figure is more than 26" high, it is preferable to use multiple leg wires per foot.

Figure 7:
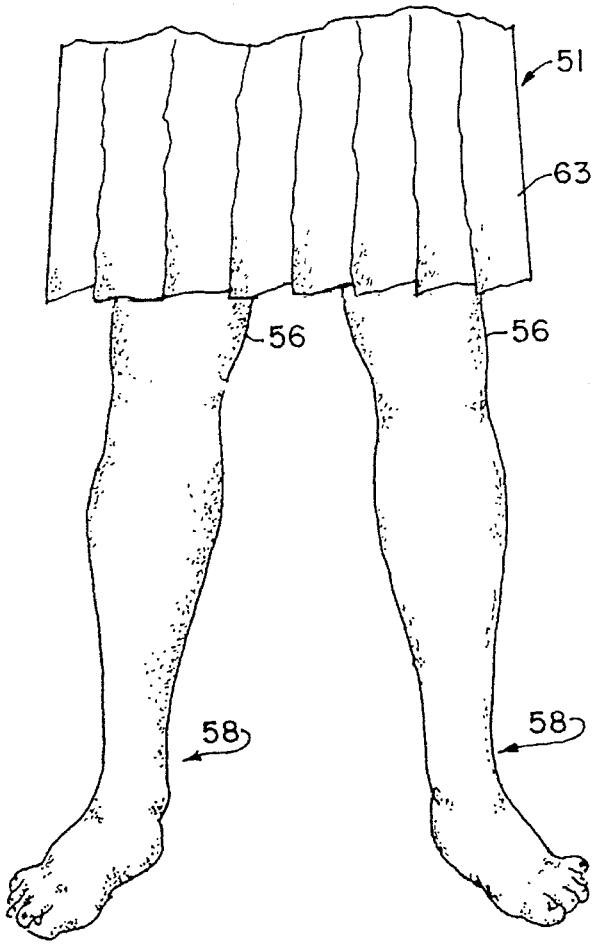
FIG. 7 is a fragmentary view in front elevation of another embodiment of figure of this invention.
Figure 8:
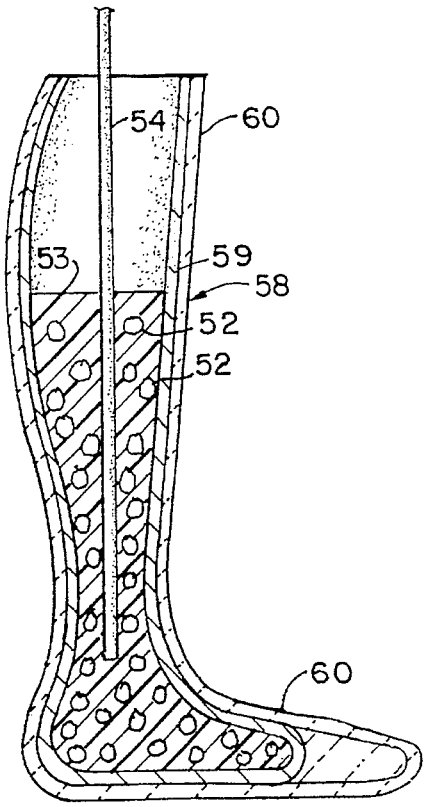
FIG. 8 is a sectional view, heightwise, of a foot assembly of the embodiment of figure shown in FIG. 7.

Referring now to FIGS. 7 and 8 for another embodiment of figure of this invention, reference numeral 51 indicates a figure, only feet assemblies 58, leg portions 56 and the lower pan of a skirt 63 of which are shown. The torso, head, arms, hands and upper leg members of the FIG. 51 can be the same as those of the figure of the first embodiment, although in either embodiment the arms can also be sculpted to above the elbows. In that case, because the arm is integral with the hand, the arm and hand together will be treated as a "hand". In the FIG. 51, foot assembly 58 is made up of an inner shell 59, of plastic, stiffened cloth or fibrous or cementitious material or any other suitable shell material, filled at least part way with lead shot 52 consolidated with a suitable resin 53. In FIG. 8, the individual shots are shown as spaced from one another. This is only for convenience of illustration, to show the resin in place. In practice, the shot fills the inner shell as far up as desired, and the resin is present only in sufficient quantity to hold the mass together, and to anchor a leg wire 54, which can be positioned before the shot is poured into the inner shell. A clay outer shell 60 is sculpted over the inner shell to create a shapely and realistic ankle and upper foot part, a well-shaped calf and part of the upper leg, and beyond the toe portion of the inner shell, to form a life-like lower foot complete with toes. The sculpted part can extend to the upper leg, but should not extend all the way to the torso. As can be appreciated from FIG. 8, although the leg wire cannot be bent at the ankle, it can still be bent above the fill in this illustrative embodiment, to permit posing of the body with respect to the foot assembly. Of course, the head and arms of the body can readily be posed because the softer wires of the armature to which they are attached admit of it.

When a solid lead foot is used under sculpted clay, a clay is used that can be fired over it. Artists' clays in common use can be fired at about 120° C. (250° F.); lead melts at about 327° C. (590° F.). In those embodiments in which resin binder is used, the clay can be fired first, and then the shot or powder poured in and the binder.

Numerous variations in the construction of the figure of this invention, within the scope of the appended claims, will become apparent to those skilled in the art in the light of the foregoing disclosure. Merely by way of example, the auxiliary ankle weight can be made solid through an upper part, with buckshot or the like immediately above the ankle part of the foot, so as to permit bending of the leg wire at the foot. The arm and head wires can be made of different malleable metals, and the leg wires secured to a different connecting piece or block; the Romex three wire cable merely provides a simple, economical, and effective way in which to accomplish the fastening of the leg wires and the provision of arm and head wires. Particularly when a shoe is used to provide a somewhat broader, flat, lower surface, it is possible to create a figure that will stand on one foot. In that case, the other foot is preferably not made heavy, and the one foot is made heavier than usual. As has been suggested, the inner shell can and preferably is extended as high as the sculpted outer shell, to provide support for the outer shell during its formation. The inner shell need not be filled entirely with shot, and if the upper leg is sculpted too high, filling the upper part with lead may tend to be counter-productive. In lieu of clay, the inner shell can be covered with cloth, as the torso generally is. A stiffly bendable lead or lead alloy strap can be used in effect as a lower part of the leg wire, shaped with a flat bottom surface forming a foot and extending up into the leg area like the shot-resin mix of the embodiment shown in FIGS. 7 and 8, or lead can be cast or molded to the appropriate foot, ankle and calf shape and covered with cloth or clay. In every variation, however, it is essential that the leg wire be stiff enough to forestall any tendency of the leg wire to bend in response to the weight of the body, including the head and hands above it and thus to sway, that it extend a substantial distance into the torso, preferably at least three-fourths of the way to the head end of the torso, that the weight of the foot assembly or assemblies exceed the weight of the rest of the figure, and that the construction of the foot assembly be such as to provide a suitable surface to engage the surface on which the figure is to stand. The figures may be made with an almost infinite variety of costumes, facial characteristics and expressions, and poses. To the end of making the leg wire sufficiently stiff, heavier gauge wire or rod or a plurality of wires or rods can be used, of iron, steel or other stiff material. The term "clay" has been used to describe the material from which the head and hands or head, arms and hands, and in one embodiment, the feet, ankles, calf and part of the upper leg of the figure, are made, but as has been indicated, the term is used broadly to include any medium that can be sculpted or molded and retain a permanent set after it has been sculpted or molded. Even different types of clay can be used for different elements of the figure. The variations listed are merely illustrative.

I claim:

1. A self-supporting, posable, upright human figure comprising an armature including leg wires of stiffly bendable material, a body supported by said leg wires, said body including a torso, head and hand members, said head and hand members weighing more than said torso, foot means fixedly connected to a lower end of each of said leg wires, at least one of said foot means having a flat lower surface for engaging a support surface but independent of said support surface, said foot means having heavy material extending from a foot part through at least a portion of a calf part of a leg of said figure and weighing more than said body including said torso, head and hands and said flat lower surface having an effective support surface-engaging area to support said body in a standing condition, said leg wires being of a stiffness effectively to resist bending in response to the weight of said head and hands and swaying of the figure said head and hands being made of clay and said torso comprising a light, soft filler said foot means comprising a clay shell disposed about and containing said foot part and said heavy material.

2. The figure of claim 1 wherein the foot means includes a shoe.

3. The figure of claim 1 wherein said leg wires extend from said foot means into said torso at least three-fourths of the way to a head end of said torso.

4. The figure of claim 1 wherein said heavy material comprises lead particles consolidated with resin.

5. The figure of claim 1 wherein said foot means includes an outer shell sculpted of clay molded and fired over a heavy metal foot form to form a clay likeness of a human foot, ankle and calf.

6. The figure of claim 5 wherein the heavy metal foot form is solid lead.

7. A self-supporting, posable, upright human figure comprising an armature including leg wires of stiffly bendable material, a body supported by said leg wires, said body including a torso, head and hand members, said head and hand members weighing more than said torso, foot means fixedly connected to a lower end of each of said leg wires, at least one of said foot means having a flat lower surface for engaging a support surface but independent of said support surface, said foot means weighing more than said body including said torso, head and hands and said flat lower surface having an effective support surface-engaging area to support said body in a standing condition, said leg wires being of a stiffness effectively to resist bending in response to the weight of said head and hands and swaying of the figure said foot means including a solid foot and ankle sack means comprising a container containing heavy particulate material, one of said ankle sack means mounted around its corresponding said leg wire immediately contiguous an upper surface of said foot adjacent a simulated ankle of said foot, whereby the weight of said foot is augmented but the leg wire can still be bent immediately above the foot.

8. The figure of claim 7 wherein the foot has integral with it a generally conical ankle section, and the ankle sack means container has a lower end that embraces said ankle section.

9. A self-supporting, posable, upright, human figure comprising an armature including leg wires of stiffly bendable material, a body supported by said leg wires, said body including a torso, head, hand, arm and leg members, and foot means fixedly connected to a lower end of said leg wires, said foot means having lower surface means in the form of a shoe with a bottom surface for engaging a support surface, but independent of said support surface, for supporting said figure in an erect and stable condition, said foot means including a solid lead foot on which said shoe is mounted and ankle sack means comprising a generally inverted cone shaped container containing buck shot, said ankle sack means embracing said leg wire immediately contiguous an upper surface of said solid foot, whereby the weight of said foot is augmented but the leg wire can still be bent immediately above said solid foot, said foot means weighing more than said body, said head and hand members being made of clay and weighing in total at least twice as much as said torso.

10. The figure of claim 9 wherein the leg wires are of a stiffness on the order of the stiffness of number 11 gauge steel tie wire and said head, arms and hands are connected to wires of a pliancy on the order of that of solid copper Romex electrical wire, supported by said leg wires.

11. A self-supporting, posable, upright human figure comprising an armature including leg wires of stiffly bendable material, a body supported by said leg wires, said body including a torso, head and hand members, said head and hand members weighing at least twice as much as said torso, foot means fixedly connected to a lower end of each of said leg wires, at least one of said foot means having lower surface means for engaging a support surface but independent of said support surface, said foot means weighing more than said body and having an effective support surface-engaging area to support said body in a standing condition, said leg wires being of a stiffness effectively to resist bending in response to the weight of said head and hands and swaying of said figure, said head and hands being sculpted to human likeness, said foot means comprising a shell containing heavy metal and being covered with clay sculpted to the likeness of a human foot, ankle and calf said heavy metal being lead in particulate form, consolidated with resin.

12. A self-supporting, posable, upright human figure comprising an armature including leg wires of stiffly bendable material, a body supported by said leg wires, said body including a torso, head and hand members, said head and hand members weighing at least twice as much as said torso, foot means fixedly connected to a lower end of each of said leg wires, at least one of said foot means having lower surface means for engaging a support surface but independent of said support surface, said foot means weighing more than said body and having an effective support surface-engaging area to support said body in a standing condition, said leg wires being of a stiffness effectively to resist bending in response to the weight of said head and hands and swaying of said figure, said head and hands being sculpted to human likeness, said foot means comprising a shell containing heavy metal and being covered with clay sculpted to the likeness of a human foot, ankle and calf, said heavy metal extending within said shell within said foot, through said ankle and into at least a part of said calf.

13. The figure of claim 12 wherein the foot member extends at least to a knee part.

* * * * *